US011754321B2

(12) United States Patent
Friedrich et al.

(10) Patent No.: US 11,754,321 B2
(45) Date of Patent: Sep. 12, 2023

(54) REFRIGERATION SYSTEM

(71) Applicant: BITZER Kuehlmaschinenbau GmbH, Sindelfingen (DE)

(72) Inventors: Axel Friedrich, Leipzig (DE); Andreas Becker, Halle (DE)

(73) Assignee: BITZER KUEHLMASCHINENBAU GMBH, Sindelfingen (DE)

( * ) Notice: Subject to any disclaimer, the term of this patent is extended or adjusted under 35 U.S.C. 154(b) by 52 days.

(21) Appl. No.: 17/029,555

(22) Filed: Sep. 23, 2020

(65) Prior Publication Data

US 2021/0003321 A1 Jan. 7, 2021

Related U.S. Application Data

(63) Continuation of application No. PCT/EP2018/057773, filed on Mar. 27, 2018.

(51) Int. Cl.

| | |
|---|---|
| ***F25B 9/00*** | (2006.01) |
| ***F25B 1/10*** | (2006.01) |
| ***F25B 31/00*** | (2006.01) |

(52) U.S. Cl.

CPC ..... *F25B 9/008* (2013.01); *F25B 1/10* (2013.01); *F25B 31/006* (2013.01)

(58) Field of Classification Search

CPC ..... F25B 1/10; F25B 9/008; F25B 31/006; F25B 31/008; F25B 31/02; F25B 31/023

See application file for complete search history.

(56) References Cited

U.S. PATENT DOCUMENTS 2,492,610 A * 12/1949 Zearfoss, Jr. ..... F25B 1/10 62/228.1

4,197,719 A 4/1980 Shaw (Continued)

FOREIGN PATENT DOCUMENTS

CA 2523821 A1 * 4/2006 ..... F25B 1/10

CN 111911462 A * 11/2020 ..... F04D 29/061

(Continued)

*Primary Examiner* — Miguel A Diaz

(74) *Attorney, Agent, or Firm* — Reinhart Boerner Van Deuren P.C.

(57) ABSTRACT

A refrigeration system, in particular a transport refrigeration system, comprising: a refrigerant circuit, which in particular works using $CO_2$ as the refrigerant and in which there is guided a total mass flow of the refrigerant; a high-pressure-side heat exchanger arranged in the refrigerant circuit and cooling refrigerant compressed to a high pressure; at least one cooling stage which expands the principal mass flow from the intermediate-pressure collector to a low pressure in at least one cooling expansion member and in so doing makes refrigeration capacity available at a low-pressure-side heat exchanger; and a refrigerant compressor unit which compresses the principal mass flow from a low pressure to a high pressure, wherein the refrigerant compressor unit has a first compressor stage for compressing, to a medium pressure, the refrigerant of the principal mass flow supplied at low pressure, and a second compressor stage for compressing, to a high pressure, the refrigerant of the principal mass flow that has been compressed to a medium pressure.

50 Claims, 6 Drawing Sheets

(56) References Cited

U.S. PATENT DOCUMENTS

| | | | | |
|---|---|---|---|---|
| 5,350,039 | A * | 9/1994 | Voss | F04D 25/06 62/505 |
| 6,009,722 | A | 1/2000 | Choi et al. | |
| 7,331,196 | B2 * | 2/2008 | Itsuki | F25B 9/008 62/513 |
| 10,139,815 | B2 * | 11/2018 | Miura | F25B 25/005 |
| 2003/0094007 | A1 * | 5/2003 | Choi | F25B 41/20 62/505 |
| 2006/0137386 | A1 * | 6/2006 | Itsuki | F25B 5/02 62/524 |
| 2008/0011014 | A1 | 1/2008 | Renz et al. | |
| 2011/0174014 | A1 * | 7/2011 | Scarcella | F25B 9/008 62/512 |
| 2015/0159919 | A1 | 6/2015 | Sato et al. | |
| 2015/0300337 | A1 * | 10/2015 | Göerlich | F04B 17/03 417/415 |
| 2017/0003679 | A1 * | 1/2017 | Miura | G05B 23/0221 |
| 2021/0003321 | A1 * | 1/2021 | Friedrich | F04B 27/0538 |

FOREIGN PATENT DOCUMENTS

| | | | | | |
|---|---|---|---|---|---|
| DE | 102005009173 | A1 | | 8/2006 | |
| DE | 102011012644 | A1 | | 8/2012 | |
| EP | 1369590 | A2 | | 10/2003 | |
| EP | 1369590 | A2 | * | 12/2003 | F01C 21/0863 |
| EP | 1426710 | A1 | * | 6/2004 | F25B 1/10 |
| EP | 1628088 | A2 | | 8/2005 | |
| EP | 1577622 | A2 | * | 9/2005 | F25B 1/10 |
| EP | 1628088 | A2 | * | 2/2006 | F25B 1/10 |
| EP | 2000752 | A1 | * | 12/2008 | F25B 40/00 |
| EP | 3136020 | A1 | * | 3/2017 | F04B 39/0246 |
| JP | 2004301074 | A | | 10/2001 | |
| JP | 2007315687 | A | * | 12/2007 | F25B 43/006 |
| JP | 2019128112 | A | * | 8/2019 | F25B 1/10 |
| WO | WO-0065232 | A2 | * | 11/2000 | F04B 27/0414 |
| WO | WO 2013/091899 | A1 | | 6/2013 | |
| WO | WO-2015129657 | A1 | * | 9/2015 | F25B 1/10 |
| WO | WO-2016117946 | A1 | * | 7/2016 | F25B 1/10 |
| WO | WO-2016182998 | A1 | * | 11/2016 | F04B 25/00 |
| WO | WO-2019185121 | A1 | * | 10/2019 | F04B 25/00 |
| WO | WO-2020132352 | A1 | * | 6/2020 | |

* cited by examiner

REFRIGERATION SYSTEM

CROSS-REFERENCE TO RELATED PATENT APPLICATION

This application is a continuation of International application number PCT/EP2018/057773 filed on Mar. 27, 2018.

This patent application claims the benefit of International application No. PCT/EP2018/057773 of Mar. 27, 2018, the teachings and disclosure of which are hereby incorporated in their entirety by reference thereto.

BACKGROUND OF THE INVENTION

The invention relates to a refrigeration system, in particular a transport refrigeration system, comprising: a refrigerant circuit, which in particular works using CO2 as the refrigerant and in which there is guided a total mass flow of the refrigerant; a high-pressure-side heat exchanger arranged in the refrigerant circuit and cooling refrigerant compressed to a high pressure; an expansion member, which is arranged in the refrigerant circuit following on from the high-pressure-side heat exchanger and in the active state cools the total mass flow of the refrigerant by expansion and in so doing generates a principal mass flow of liquid refrigerant and an auxiliary mass flow of gaseous refrigerant, which enter an intermediate-pressure collector and are separated therein into the principal mass flow and the auxiliary mass flow; at least one cooling stage which expands the principal mass flow from the intermediate-pressure collector to a low pressure in at least one cooling expansion member and in so doing makes refrigeration capacity available at a low-pressure-side heat exchanger; and a refrigerant compressor unit which compresses the principal mass flow from a low pressure to a high pressure.

Refrigeration systems of this kind are known from the prior art.

In those systems there is the problem of being able to construct the refrigeration system as easily as possible and in a manner working as efficiently as possible, in particular for operation as a transport refrigeration system.

SUMMARY OF THE INVENTION

This problem, in a refrigeration system of the kind described at the outset, is solved in accordance with the invention in that the refrigerant compressor unit has a first compressor stage for compressing, to a medium pressure, the refrigerant of the principal mass flow supplied at low pressure, and a second compressor stage for compressing, to a high pressure, the refrigerant of the principal mass flow that has been compressed to a medium pressure, and in that the auxiliary mass flow from the intermediate-pressure collector enters the second compressor stage of the refrigerant compressor unit for compressing to a high pressure.

The solution according to the invention therefore creates a simple possibility for operating a refrigeration system having a refrigerant compressor unit, in which the principal mass flow and the auxiliary mass flow may be compressed optimally to a high pressure.

In particular, the refrigeration system according to the invention creates the possibility of using CO2 as the refrigerant and at the same time of operating the refrigeration system optimally.

It is particularly favorable in the solution according to the invention if the first compressor stage of the refrigerant compressor unit is connected to a medium-pressure-side heat exchanger, which cools the principal mass flow that has been compressed to a medium pressure before said principal mass flow enters the second compressor stage.

This solution creates the possibility—in particular when using CO2 as the refrigerant—to cool the refrigerant, which will have been heated significantly during the compression to a medium pressure, before said refrigerant is compressed to a high pressure.

In principle, the medium-pressure-side heat exchanger could be cooled by any media.

For example, it would also be conceivable to arrange the medium-pressure-side heat exchanger such that it is cooled by the refrigerant flowing at low pressure to the refrigerant compressor unit.

A particularly simple solution, however, provides that the medium-pressure-side heat exchanger is an external heat exchanger arranged outside the refrigerant compressor unit.

This external heat exchanger may be cooled by all kinds of media. It is particularly advantageous if ambient air is used for the cooling.

With regard to the expansion of the total mass flow by the expansion member following on from the high-pressure-side heat exchanger, it has not been defined to what pressure the expansion should be performed; it is merely provided that the expansion member expands the pressure to an intermediate pressure.

One possibility is that the intermediate pressure is higher than the medium pressure and that the auxiliary mass flow is expanded to a medium pressure by an auxiliary mass flow expansion member and enters the second compressor stage at medium pressure.

Another advantageous possibility provides that the intermediate pressure corresponds substantially to the medium pressure, such that the total mass flow may be expanded to a medium pressure by the expansion member following on from the first external heat exchanger.

No further details have yet been provided with regard to the pressure levels at which the refrigeration systems are operated.

One advantageous solution thus provides that, with CO2 as refrigerant, the low pressure lies in the range of from 1 bar 60 bar.

Furthermore, it is preferably provided that, with CO2 as refrigerant, the medium pressure lies in the range of from 20 bar 120 bar.

Furthermore, it is preferably provided that, with CO2 as refrigerant, the high pressure lies in the range of from 50 bar to 160 bar.

No further details have yet been provided with regard to the structure of the refrigerant compressor unit.

In accordance with one advantageous solution, the refrigerant compressor unit has a refrigerant compressor and an electric drive motor.

In this case, it is particularly advantageous if the auxiliary mass flow, prior to entering the second compressor unit, is supplied to a motor chamber of the refrigerant compressor unit in order to cool the electric drive motor.

It is particularly favorable if the auxiliary mass flow enters the second compressor stage after cooling of the electric drive motor in the motor chamber.

A further advantageous solution provides that the principal mass flow compressed to a medium pressure enters the motor chamber for cooling of the electric drive motor after the cooling by the medium-pressure-side heat exchanger and prior to entry into the second compressor stage.

It has proven particularly expedient here if the principal mass flow compressed to a medium pressure and cooled by the medium-pressure-side heat exchanger enters the second compressor stage after having passed through the motor chamber.

In addition, it is preferably provided that a drive chamber of the refrigerant compressor, from which the compressor stages are driven, is held at medium pressure.

This has the advantage that a pressure difference exists in particular in the second compressor stage at most between medium pressure and high pressure, and therefore the mechanical loading of the individual components of the compressor stages may be kept to a minimum.

In this regard, it has proven to be expedient if the drive chamber is connected to the motor chamber via a connecting channel and/or if the refrigerant, after cooling the electric drive motor in the motor chamber, passes through the drive chamber.

A particularly advantageous solution provides that the refrigerant compressor unit is formed as a semi-hermetic compressor, wherein both the electric drive motor and the refrigerant compressor are arranged in an overall housing of said compressor.

Furthermore, no further details have yet been provided with regard to the construction of the refrigerant compressor itself.

In accordance with one advantageous solution, the refrigerant compressor of the refrigerant compressor unit is formed as a reciprocating compressor, since, in particular with a reciprocating compressor of this kind, the pressures specified for CO2 as refrigerant are achievable with a reasonable mechanical outlay.

It is particularly advantageous if the reciprocating compressor has a plurality of cylinder units, of which at least one forms the first compressor stage and at least one forms the second compressor stage.

It is particularly favorable if the two compressor stages are configured such that the ratio of the swept volume of the first compressor stage to the swept volume of the second compressor stage lies in the range of from 1.5/1 to 2/1.

In this regard, it is provided in particular that at least two cylinder units form the first compressor stage.

Furthermore, it is preferably provided that the at least one second cylinder unit of the second compressor stage is arranged at an angular spacing relative to the at least one cylinder unit of the first compressor stage, based on a central axis of the drive shaft of the cylinder units, such that for example the cylinder units of the two compressor stages may thus be arranged in a V shape or oppositely directed, in particular in order to achieve an advantageous torque distribution.

Another advantageous solution provides that all cylinder units of the compressor stages are arranged in a row.

It is furthermore preferably provided that the housing of the refrigerant compressor and in particular the overall housing of the refrigerant compressor unit is formed from aluminum.

A further advantageous development provides that the overall housing of the refrigerant compressor unit has a housing case and bearing covers arranged on either side of the housing case, these all being formed from aluminum.

Furthermore, it is preferably provided that the housing has cylinder heads which are formed from aluminum.

No further details have yet been provided with regard to the arrangement of the various connections on the refrigerant compressor unit.

An advantageous solution provides that a high-pressure connection of the refrigerant compressor unit is arranged on a cylinder head of the second compressor stage.

A further advantageous solution provides that a low-pressure connection of the refrigerant compressor unit is arranged on a cylinder head of the first compressor stage.

In addition, it is advantageously provided that a medium-pressure outlet of the refrigerant compressor unit is arranged on a cylinder head of the first compressor stage.

It is furthermore expediently provided that a medium-pressure inlet of the refrigerant compressor unit is arranged in the region of a motor housing.

In addition, the invention relates to a refrigerant compressor unit, in particular for compressing CO2 as refrigerant, comprising a refrigerant compressor and an electric drive motor, wherein the refrigerant compressor has a first compressor stage for compressing, to a medium pressure, refrigerant, in particular CO2, supplied at low pressure, and a second compressor stage for compressing, to a high pressure, the refrigerant, in particular CO2, that has been compressed to a medium pressure, and wherein in particular the refrigerant compressor unit has a medium-pressure outlet connected to the first compressor stage and a medium-pressure inlet connected to the second compressor stage.

The advantage of this solution is considered to be the fact that the refrigerant compressed to a medium pressure may thus be guided out from the refrigerant compressor through the medium-pressure outlet and for example may be cooled and then supplied back to the refrigerant compressor unit via the medium-pressure inlet.

In addition, it is also possible not only to connect the medium-pressure inlet to the medium-pressure outlet, but, via the medium-pressure inlet, to convey refrigerant accumulating in a refrigerant circuit, which refrigerant is present for example likewise at medium pressure, to the second compressor stage and to compress said refrigerant to a high pressure in the second compressor stage.

The refrigerant compressor according to the invention may thus be used advantageously in particular in a refrigerant circuit with expansion of the refrigerant to an intermediate pressure, in order to compress back to a high pressure not only the refrigerant compressed to a medium pressure in the first compressor stage, but also the refrigerant expanded to an intermediate pressure.

Furthermore, a solution in which the medium-pressure inlet opens out into a motor chamber of the electric drive motor in order to cool the electric drive motor, and that refrigerant enters the second compressor stage after having passed through the motor chamber has also proven to be particularly favorable.

This means that, in a refrigerant compressor unit of this kind, it is possible to use the refrigerant supplied to the refrigerant compressor unit via the medium-pressure inlet also to cool the drive motor prior to the refrigerant being compressed in the second compressor stage.

In addition, it is advantageously provided in a refrigerant compressor unit according to the invention that a drive chamber of the refrigerant compressor, from which the compressor stages are driven, is held at medium pressure.

A solution of this kind has the great advantage that, due to the presence of medium pressure in the drive chamber, the mechanical loading of the components of the compressor stages is reduced, since there is merely a pressure difference between medium pressure and high pressure or low pressure and medium pressure.

In order to achieve this it is preferably provided that the drive chamber is connected to the motor chamber via a connecting channel.

The connecting channel may be configured here such that it leads merely to a pressure balance between the drive chamber and the motor chamber, however the connecting channel may also be configured such that refrigerant passing through the motor chamber is supplied to the second compressor stage by means of said connecting channel.

A particularly advantageous solution provides that the refrigerant compressor unit is formed as a semi-hermetic compressor, wherein both the electric drive motor and the refrigerant compressor are arranged in an overall housing of the semi-hermetic compressor.

This solution on the one hand has the advantage that it is very compact and on the other hand the advantage that the refrigerant thus may be used easily to cool the electric drive motor prior to being supplied to the second compressor stage.

A particularly favorable solution provides that the refrigerant compressor is formed as a reciprocating compressor, since with a reciprocating compressor it is possible, with reasonable mechanical outlay, to achieve the pressure differences that are necessary in particular for the compression of CO2 as refrigerant.

The reciprocating compressor is preferably formed such that the reciprocating compressor has a plurality of cylinder units, at least one of which forms the first compressor stage and at least one of which forms the second compressor stage.

In principle, one cylinder unit for each compressor stage would be sufficient. However, in order to achieve a favorable distribution of the volumes to be compressed over the cylinder units, it has proven to be advantageous if at least two cylinder units form the first compressor stage.

It has also proven to be advantageous for structural reasons if the at least one cylinder unit of the second compressor stage is arranged at an angular spacing relative to the at least one cylinder unit of the first compressor stage, based on a central axis of the drive shaft of the cylinder units, in order to arrange the various cylinder units either in a V shape or oppositely directed to one another.

Another expedient solution provides that the cylinder units of the compressor stages are arranged in a row, which results in a very compact construction.

No further details regarding the construction of the housing were provided in conjunction with the prior explanation of the structure of the refrigerant compressor unit according to the invention.

It is preferably provided that the housing of the refrigerant compressor, in particular the housing of the refrigerant compressor unit, is formed from aluminum.

A housing of this kind of the refrigerant compressor unit on the one hand is capable of withstanding the high pressures and thus has a sufficient stability, and on the other hand, in particular in the case of use in a transportable cooling unit, has a minimal mass.

In particular in the case of an overall housing, it has proven to be expedient if the overall housing of the refrigerant compressor unit comprises a housing case and bearing covers arranged on either side of the housing case, these all being formed from aluminum.

A further advantageous embodiment provides that the housing comprises cylinder heads which are formed from aluminum.

No further details have yet been provided with regard to the various connections for high pressure and low pressure.

An advantageous solution provides that a high-pressure connection of the refrigerant compressor unit is arranged on a cylinder head of the second compressor stage.

A further advantageous solution provides that a low-pressure connection of the refrigerant compressor unit is arranged on a cylinder head of the first compressor stage.

A further expedient solution provides that a medium-pressure outlet of the refrigerant compressor unit is arranged on a cylinder head of the first compressor stage.

It is furthermore preferably provided that a medium-pressure inlet of the refrigerant compressor unit is arranged in the region of a motor housing.

In addition, it is provided in particular that, with CO2 as refrigerant, the low pressure lies at values in the range of from 1 bar to 60 bar.

It is furthermore expedient if, with CO2 as refrigerant, the medium pressure lies in the range of from 20 bar to 120 bar.

Lastly, it is advantageous if, with CO2 as refrigerant, the high pressure lies at values in the range of from 50 bar to 160 bar.

In addition, it is preferably provided that a refrigerant compressor unit of this kind is arranged in a refrigeration system according to the features described above.

Further features and advantages of the invention are the subject of the following description and the schematic illustration of a number of exemplary embodiments.

DETAILED DESCRIPTION OF THE INVENTION

Figure 1:
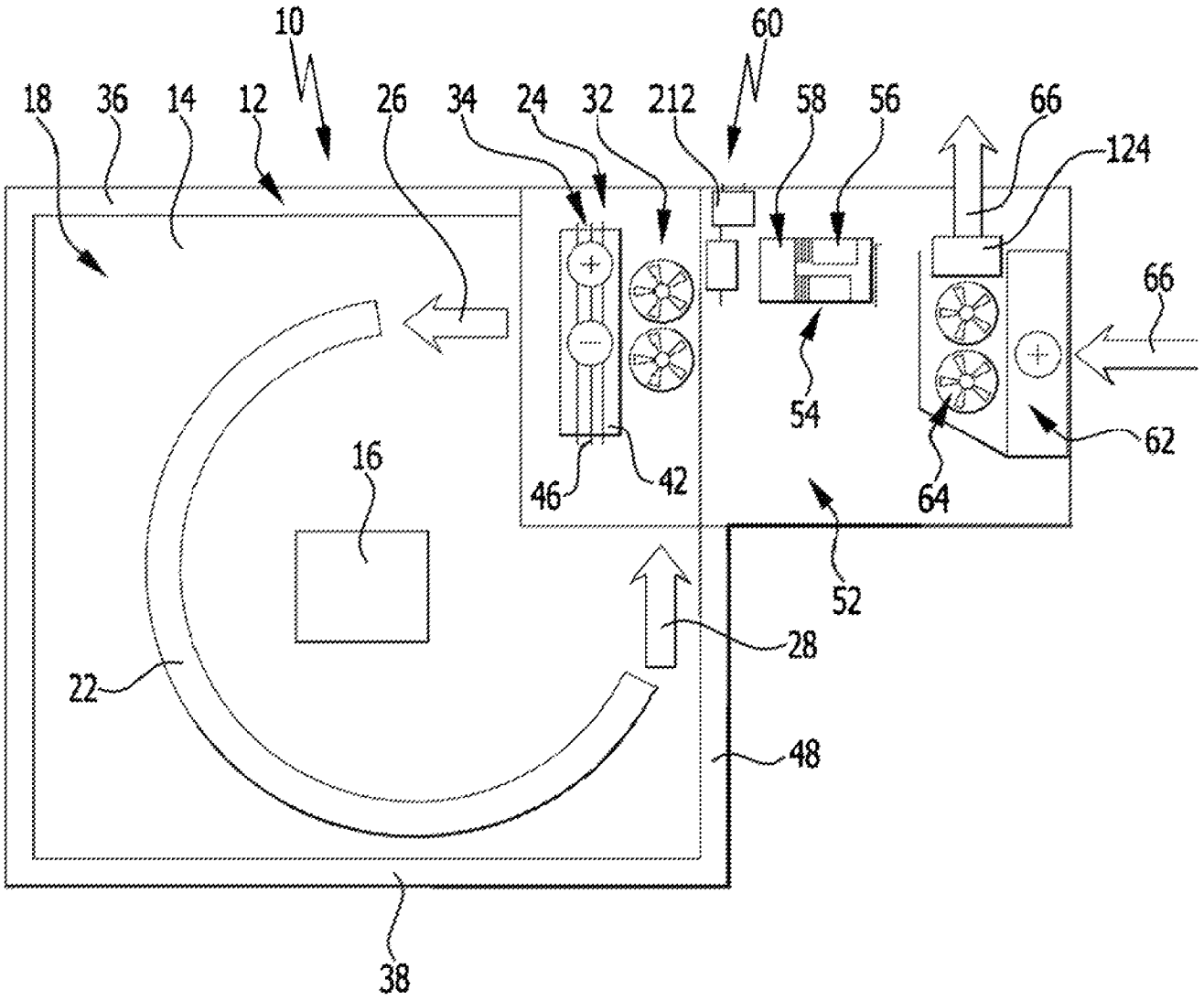
FIG. 1 shows a schematic illustration of a cooling unit, in particular formed as a transport cooling unit, with a refrigeration system according to the invention.

A cooling unit denoted as a whole by 10 comprises a thermally insulated housing 12, which encloses an interior 14, in which temperature-sensitive goods 16 or temperature-sensitive cargo 16 may be stored, the temperature-sensitive goods 16 or the temperature-sensitive cargo 16 being surrounded by a gaseous medium 18, in particular air, which is held at a defined temperature level in order to keep the temperature-sensitive cargo 16 or the temperature-sensitive goods 16 within a specified temperature range.

The cooling unit 10 is preferably formed as a transportable cooling unit, for example as a structure for a lorry or a freight wagon or as a conventional transport container for transporting temperature-sensitive cargo 16 either by lorry or train or ship.

In order to be able to maintain a defined or pre-specified temperature range for the cargo 16, a circulation flow 22 of the gaseous medium 18 is circulated in the interior 14, wherein, starting from a temperature-control unit 24, an inlet flow 26 enters the interior 14, passes through it, and enters the temperature-control unit 24 again as an outlet flow 28.

The circulation flow 22 is generated here by a fan unit 32, which is arranged in the temperature-control unit 24 and is held at the desired temperature by an internal heat exchanger 34, which is arranged in a temperature-control unit 24.

In this case, the inlet flow 26 preferably exits from the temperature-control unit 24 in a region close to a top wall 36 of the insulated housing 12, and the circulation flow 22 is preferably guided close to a bottom wall 38 of the insulated housing 12 back to the temperature-control unit 24, and in so doing forms the outlet flow 28 passing back to the temperature-control unit 24.

In particular, the temperature-control unit 24 is arranged close to the top wall 36 of the insulated housing 12 and for example close to a front wall 48 or close to a rear wall 48 of the housing.

An equipment unit 52 comprising a refrigerant compressor unit 54 with a refrigerant compressor 56 and an electric drive motor 58 is arranged preferably close to the temperature-control unit 24 on the thermally insulated housing 12, wherein the equipment unit 52 preferably also additionally comprises a first external heat exchanger 62 and an external fan unit 64, which for example generates an airflow 66 from ambient air, which airflow passes through the first external heat exchanger 62.

Figure 2:
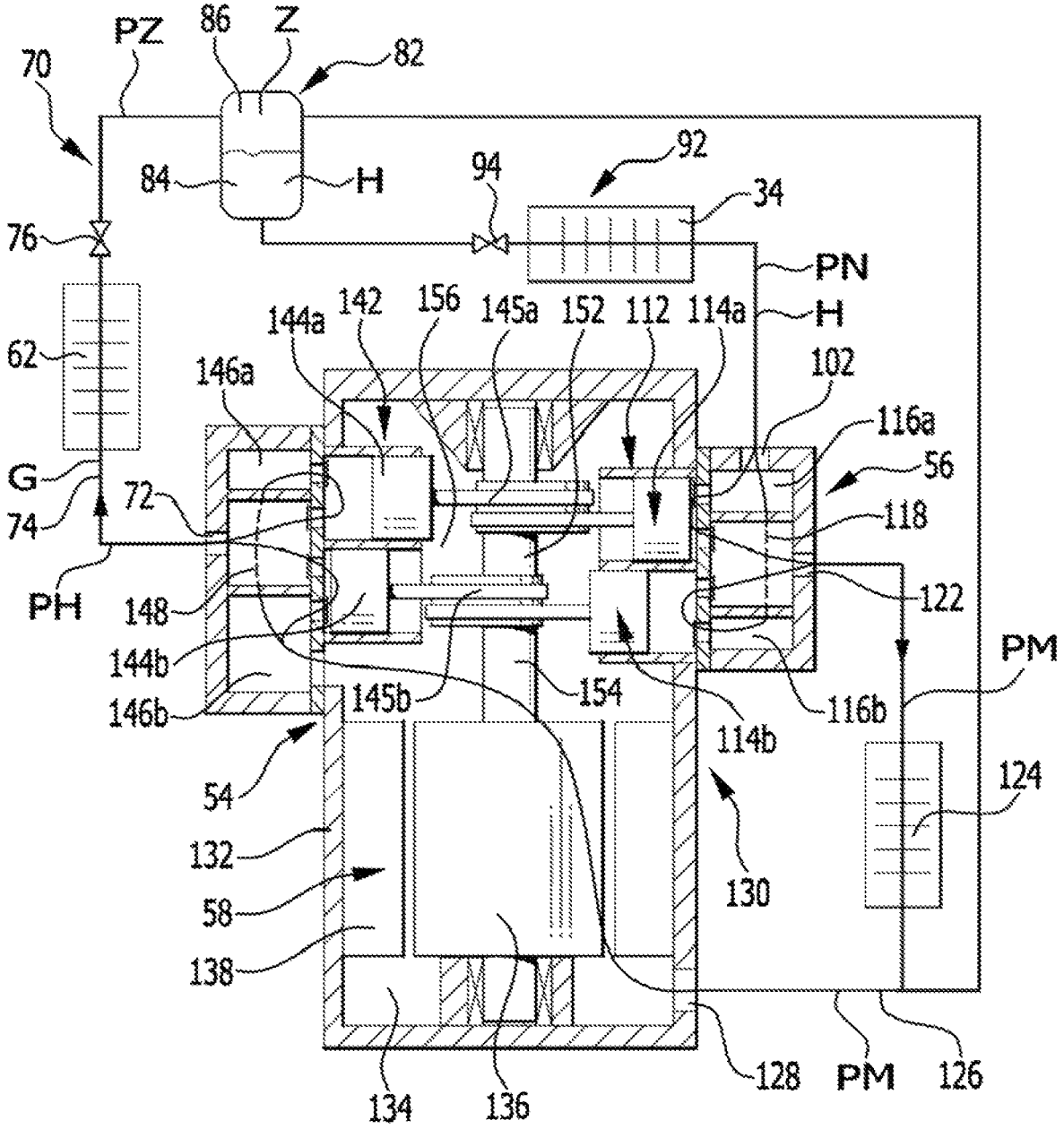
FIG. 2 shows a schematic illustration of a first exemplary embodiment of a refrigeration system according to the invention.

As shown in FIG. 2, the refrigerant compressor unit 54, the inner heat exchanger 34, and the first external heat exchanger 62 are arranged in a refrigerant circuit of a refrigeration system 60 integrated in the cooling unit, said refrigerant circuit being denoted as a whole by 70.

The refrigerant circuit 70 is connected to a high-pressure connection 72 of the refrigerant compressor unit 54, starting from which high-pressure connection a supply line 74 to the first external heat exchanger 62 leads, which heat exchanger cools a total mass flow G of refrigerant, in the present case in particular CO2, compressed to a high pressure by the refrigerant compressor 54, the refrigerant being present, in the case of CO2, in a trans-critical state.

In this case, the refrigerant may be cooled in the first external high-pressure-side heat exchanger unit 62 either by ambient air, or also by contact with a heat-absorbing medium of any kind, for example also cooling water.

After the external heat exchanger 62, the total mass flow G supplied at the high-pressure connection 72 of the refrigerant compressor unit 54 in the refrigerant circuit 70 passes through, in the case of CO2 in a trans-critical state, an expansion member 76 arranged in the refrigerant circuit 70, is expanded by said expansion member to an intermediate pressure PZ, and then enters an intermediate-pressure collector 82, in which the total mass flow G cooled by expansion divides into a principal mass flow H of liquid refrigerant, which settles in the form of a liquid refrigerant bath 84 in the intermediate-pressure collector 82, and an auxiliary mass flow Z, which forms a gas bubble 86 above the liquid bath 84.

The principal mass flow H of liquid refrigerant, starting from the intermediate-pressure collector 82, is supplied to a cooling stage 92, which comprises a cooling expansion member 94, which cools the principal mass flow H to a low pressure PN by expansion, and, starting from here, the principal mass flow H enters the internal low-pressure-side heat exchanger 34, in which, due to the fact that refrigeration capacity has been made available, it is able to draw heat from the circulation flow 22 in the interior 18 of the cooling unit 10.

The principal mass flow H heated in the heat exchanger 34 then enters the refrigerant compressor unit 54 at low pressure PN via a low-pressure connection 102.

Figure 3:
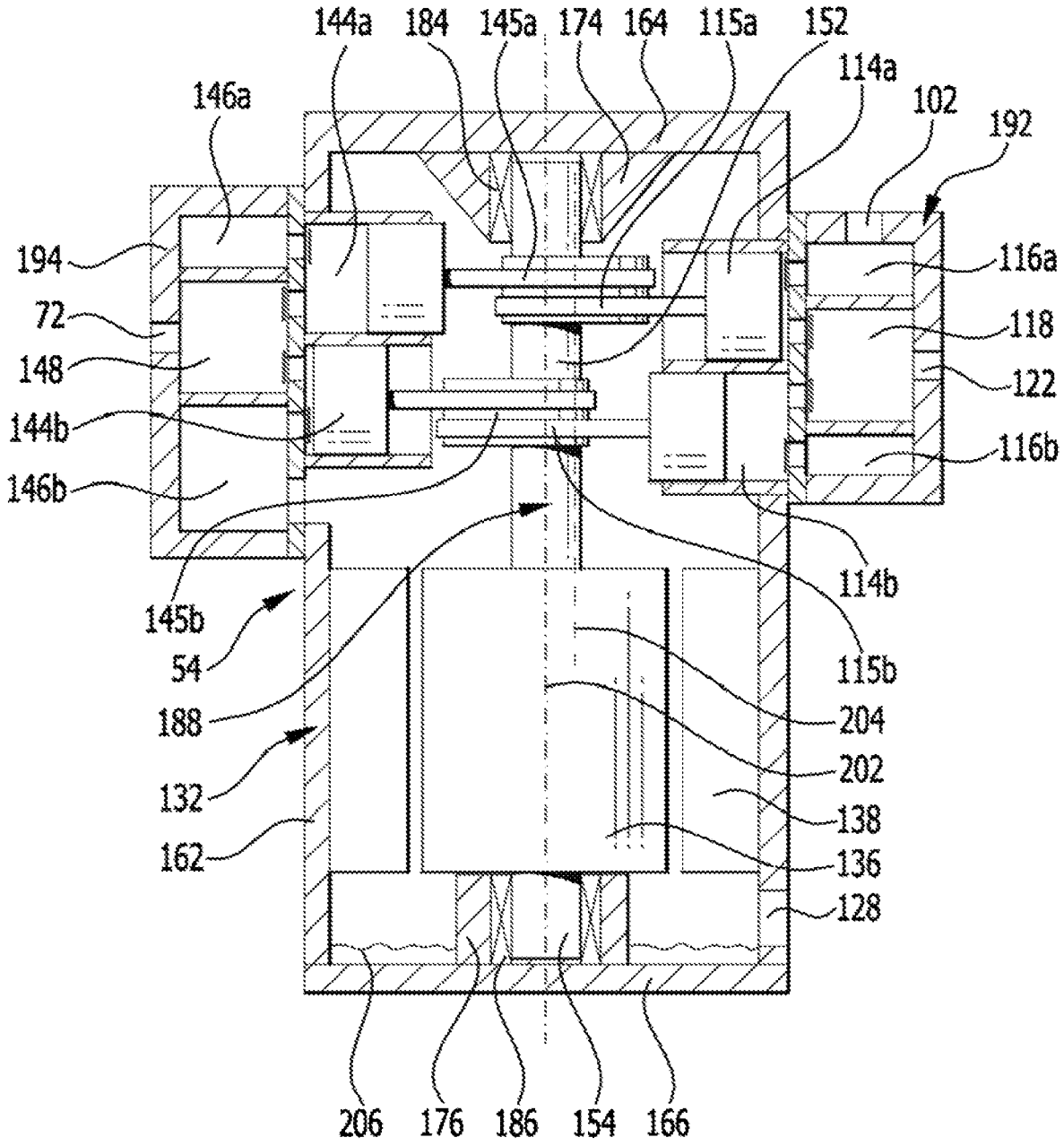
FIG. 3 shows a schematic enlarged illustration of a refrigerant compressor unit for the first exemplary embodiment of the refrigeration system according to the invention.

The refrigerant compressor 56 of the refrigerant compressor unit 54, as shown in FIG. 2 and FIG. 3, is formed as a reciprocating compressor and preferably comprises a first compressor stage 112, formed by two cylinder units 114*a* and 114*b*, each driven by a cylinder drive 115*a*, 115*b*, in particular an eccentric drive, each of which draws in the refrigerant of the principal mass flow H from an inlet chamber 116*a*, 116*b* and delivers it for example into a common outlet chamber 118. In so doing, the first compressor stage 112 compresses the refrigerant from the principal mass flow H supplied to the first compressor stage at low pressure, for example at values from 1 bar to 60 bar, to a medium pressure PM, which for example lies at values in the range of from 20 bar to 120 bar.

The principal mass flow H compressed to a medium pressure PM is then supplied from a medium-pressure outlet 122 of the common outlet chamber 118 to a second external medium-pressure-side heat exchanger 124, which for example is likewise arranged in the equipment unit 52 and for example is likewise passed through by the external airflow 66.

Due to the second external medium-pressure-side heat exchanger 124, it is possible to cool the refrigerant of the principal mass flow H compressed to a medium pressure PM back to a temperature close to ambient temperature, and to remove again from said refrigerant a significant part of the heat supplied during the compression.

The cooled refrigerant of the principal mass flow H compressed to a medium pressure PM is supplied from the second external medium-pressure-side heat exchanger 124 to a medium-pressure inlet 128 of the refrigerant compressor unit 54 via a medium-pressure supply line 126, the medium-pressure inlet 128 being arranged on a motor housing 132 of the refrigerant compressor unit 54.

In addition, the medium-pressure supply line 126 is also connected to the fan 86 of the intermediate-pressure collector 82, so that the auxiliary mass flow Z from the intermediate-pressure collector 82 is supplied via the medium-pressure supply line 126 likewise to the medium-pressure connection 128 of the refrigerant compressor unit 54, and the medium pressure PM adjusts so that it corresponds to the intermediate pressure PZ.

The medium-pressure inlet 128 is preferably arranged on the motor housing 132 so that the incoming refrigerant enters a motor chamber 134, passes through the motor chamber 134 whilst cooling the electric drive motor 58, in particular whilst cooling a rotor 136 and a stator 138 of the electric drive motor, and then enters a second compressor stage 142 of the refrigerant compressor unit 54.

The second compressor stage 142 likewise comprises two cylinder units 144*a* and 144*b* each driven by a cylinder drive 145*a*, 145*b*, in particular an eccentric drive, wherein the refrigerant compressed to a medium pressure PM and supplied to the second compressor stage 142 enters the cylinder units 144*a* and 144*b* via inlet chambers 146*a* and 146*b*, is compressed in said cylinder units, and then exits into an outlet chamber 148, which is connected to the high-pressure connection 72.

In the first exemplary embodiment of the reciprocating compressor 54 according to the invention, the cylinder units 114*a* and 114*b* of the first compressor stage 112 and the cylinder units 144*a* and 144*b* of the second compressor stage 142 are driven via a common drive shaft 152, in particular a camshaft, which acts on the various cylinder drives 115*a*, 115*b* and 145*a*, 145*b*, is preferably connected coaxially with and in particular integrally to a rotor shaft 154 of the rotor 136, and together therewith forms an overall drive shaft 188.

Furthermore, in the first exemplary embodiment of the refrigerant compressor unit 54, the cylinder drive chamber 156 receiving the drive shaft 152 and the cylinder drives 115*a*, 115*b*, 145*a*, 145*b* and bordering on the cylinder units 114*a* and 114*b* and also 144*a* and 144*b* is connected to the motor chamber 134 or transitions into the motor chamber, so that the cylinder drive chamber 156 is at medium pressure.

This has the advantage that, as a result, in particular at the second compressor stage 142, only pressure differences between medium pressure and high pressure occur in the cylinder units 144*a* and 144*b*, and therefore the loading of cylinder drives 145*a* and 145*b* for the cylinder units 144*a*, 144*b* is lower than in the case of low pressure in the cylinder drive chamber 156.

Similarly, the loading of the cylinder units 144*a* and 144*b* themselves, in particular of the pistons thereof, is also lower than in the case of low pressure in the cylinder drive chamber 156.

As shown in FIG. 3, in the first exemplary embodiment of the refrigerant compressor unit 54 according to the invention, this is formed as a semi-hermetic compressor, in which the refrigerant compressor 56 and the electric drive motor 58 are arranged in an overall housing 130, which comprises a housing case 162, bearing covers 164 and 166 arranged on either side of the housing case 162, and bearing receptacles 174 and 176, which are integrally molded on the bearing covers 164 and 166 and which are formed from aluminum, wherein rolling bearings 184 and 186 are arranged in the bearing receptacles 174 and 176 and in this case support an overall drive shaft 188, comprising the drive shaft 152 and the rotor shaft 154.

Furthermore, cylinder heads 192 and 194 are arranged on the housing case 162 and are likewise formed from aluminum, wherein the cylinder head 192 is associated with the cylinder units 114*a* and 114*b* and has the low-pressure connection 102, which is connected to the inlet chambers 116*a* and 116*b*, and has the outlet chamber 118, which is connected to the medium-pressure outlet 122.

The cylinder head 194 is associated here with the cylinder units 144*a* and 144*b*, wherein the inlet chambers 146*a* and 146*b* are connected to the motor chamber 134 and/or the cylinder drive chamber 156, and the outlet chamber 148 is connected to the high-pressure connection 72.

In the first exemplary embodiment of the refrigerant compressor unit 54 according to the invention, this is preferably arranged as an upright compressor, that is to say a central axis 202 of the overall drive shaft 188 runs substantially vertically, that is to say deviates at most by ±30° from a vertical.

In order to deliver lubricant into the cylinder drive chamber 156, in particular to the cylinder drives 115*a*, 115*b*, 145*a*, 145*b*, for example a delivery channel 204 running at an incline to the central axis 202 of the overall drive shaft 188 is provided in said overall drive shaft and delivers lubricant into the cylinder drive chamber 156 from a lubricant sump 206 that forms above the lowermost cover 166 as considered in the direction of the force of gravity on account of the centrifugal force effective in the delivery channel.

Alternatively, a lubricant pump unit driven by the electric drive motor 58 is provided in order to deliver the lubricant in the cylinder drive chamber 156.

In order to control the electric drive motor 58, a converter 212 is also provided, which is likewise preferably arranged in the equipment unit 52.

The speed of the electric drive motor 58 is controllable by means of this converter, and therefore the refrigeration capacity of the refrigerant compressor unit 54 is also controllable continuously within a designated power range.

Figure 4:
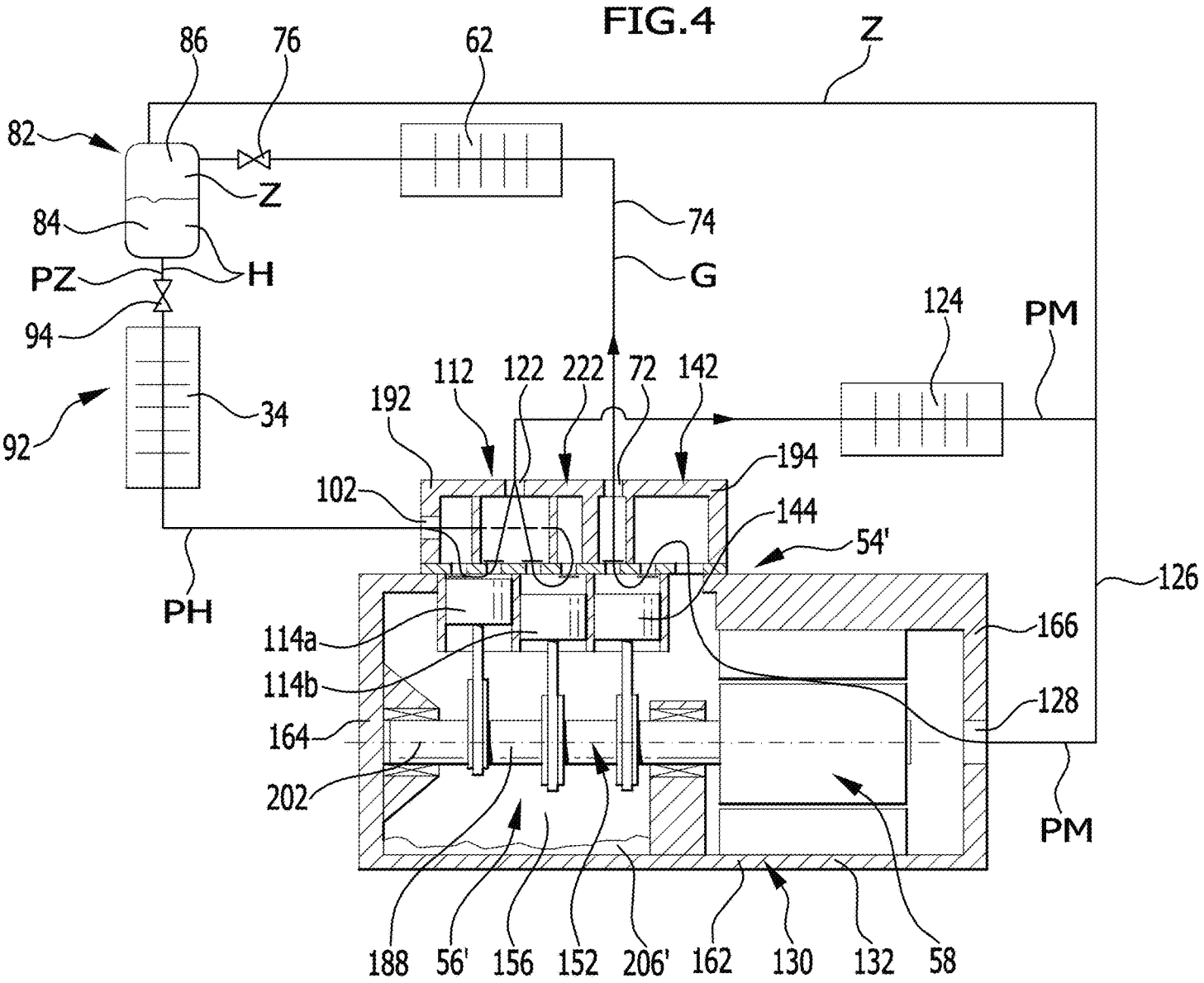
FIG. 4 shows a schematic illustration of a second exemplary embodiment of a refrigeration system according to the invention.
Figure 5:
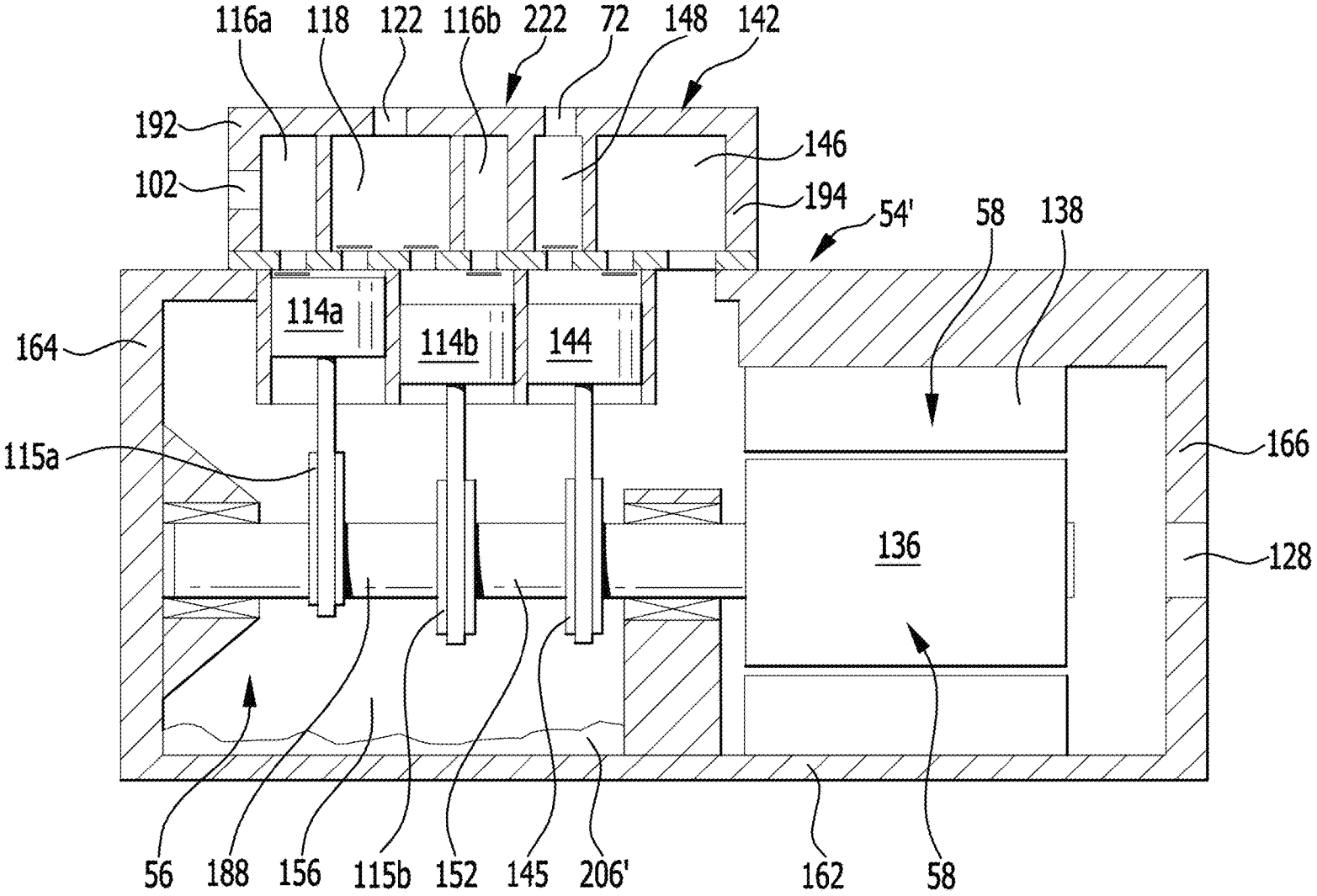
FIG. 5 shows an enlarged illustration of the refrigerant compressor unit of the second exemplary embodiment of the refrigeration system according to the invention.

In a second exemplary embodiment of a refrigeration system 60' according to the invention, shown in FIG. 4 and FIG. 5, those elements that are identical to those in the first exemplary embodiment are provided with like reference signs, and therefore, with regard to the description of said elements, reference may be made fully to the comments provided in relation to the first exemplary embodiment.

In contrast to the first exemplary embodiment, the refrigerant compressor unit 54' is provided with a refrigerant compressor 56', which, in order to form the first compressor stage 112, comprises two cylinder units 114*a* and 114*b*, but, in order to form the second compressor stage 142, comprises just one cylinder unit 144, wherein all cylinder units 114*a*, 114*b* and 144 are driven by the common drive shaft 152.

The ratio of the swept volume of the first compressor stage 112 to the swept volume of the second compressor stage 142 lies approximately in the range of from 1.5/1 to 2/1.

In principle, it would be possible to arrange the cylinder units 114*a*, 114*b* and 144 at an angular spacing based on the central axis 202 of the drive shaft 152.

A particularly advantageous solution, however, provides that the cylinder units 114*a*, 114*b* and 144 are arranged in a row.

Furthermore, the cylinder head 192 associated with the first compressor stage 112, and the cylinder head 194 associated with the second compressor stage 142 are thus also combined to form an overall cylinder head 222, in which both the low-pressure connection 102, the medium-pressure outlet 122, and the high-pressure connection 72 are provided, whilst the medium-pressure inlet 128 is provided on the motor housing 132, for example on a side of the electric drive motor 58 opposite the cylinder drive chamber 156.

In the second exemplary embodiment of the refrigerant compressor unit 54', the overall drive shaft 188 is preferably arranged so that its central axis 202 runs substantially horizontally, that is to say for example deviates by most ±30° from an exactly horizontal orientation, wherein a lubricant sump 206' is formed in particular in the lowermost region of the cylinder drive chamber 156 as considered in the direction of the force of gravity, and the cylinder drives 115*a*, 115*b*, 145 are lubricated from said lubricant sump.

Figure 6:
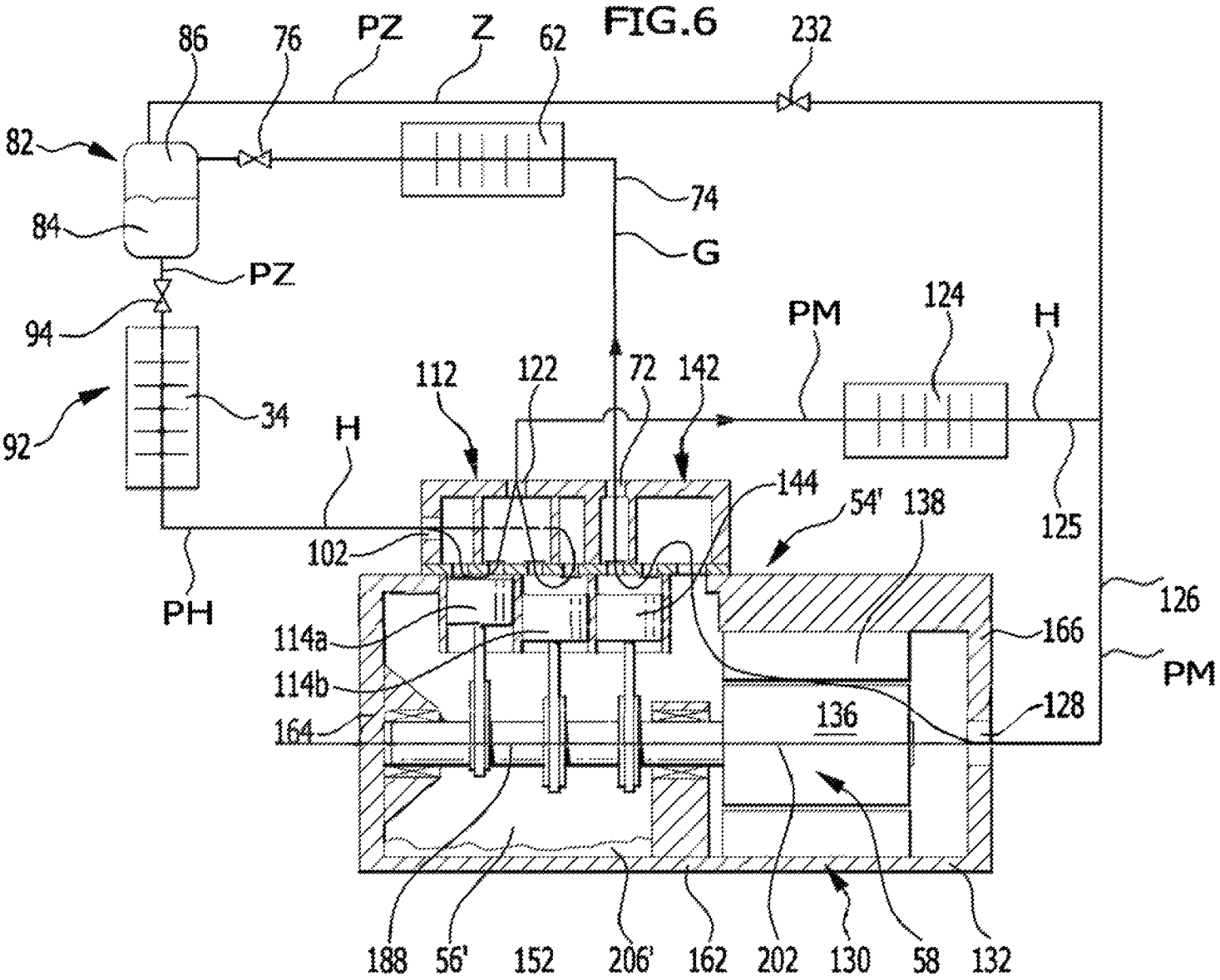
FIG. 6 shows a third exemplary embodiment of a refrigeration system according to the invention.

In a third exemplary embodiment of a refrigeration system according to the invention, shown in FIG. 6, which is based on the second exemplary embodiment, a valve 232 is also provided in the medium-pressure supply line 126 leading away from the intermediate-pressure collector and towards the medium-pressure inlet 128, which valve is arranged in particular between the intermediate-pressure collector 82 and an outlet of a medium-pressure line 125 leading from the second external heat exchanger 124 to the medium-pressure supply line 126 and thus makes it possible to set an intermediate pressure PZ in the intermediate-pressure collector 82, in such a way that this intermediate pressure does not necessarily have to be identical to the medium pressure PM, and instead it is possible to keep the intermediate pressure PZ higher than the medium pressure PM.

If the valve 232 is formed here as an expansion valve, it is thus possible, when the auxiliary mass flow is expanded by the expansion valve 232, to additionally also cool the auxiliary mass flow, so that this auxiliary mass flow has an improved cooling effect when cooling the electric drive motor 58.

In addition, in the third exemplary embodiment, those elements that are identical to those in the previous exemplary embodiments are also provided with like reference signs, and therefore reference is made to the comments in relation to the previous exemplary embodiments.

The invention claimed is:

1. A refrigeration system, comprising:

a refrigerant circuit, which uses a refrigerant and in which there is guided a total mass flow of the refrigerant;

a high-pressure-side heat exchanger arranged in the refrigerant circuit and cooling refrigerant compressed to a high pressure;

an expansion member, which is arranged in the refrigerant circuit following on from the high-pressure-side heat exchanger and in the active state cools the total mass flow of the refrigerant by expansion and in so doing generates a principal mass flow of liquid refrigerant and an auxiliary mass flow of gaseous refrigerant, which enter an intermediate-pressure collector and are separated therein into the principal mass flow and the auxiliary mass flow;

at least one cooling stage which expands the principal mass flow from the intermediate-pressure collector to a low pressure in at least one cooling expansion member and in so doing makes refrigerating capacity available at a low-pressure-side heat exchanger;

a refrigerant compressor unit which compresses the principal mass flow from a low pressure to a high pressure, the refrigerant compressor unit comprising a plurality of cylinder units and a plurality of cylinder drives;

wherein the refrigerant compressor unit has a first compressor stage for compressing, to a medium pressure, the refrigerant of the principal mass flow supplied at low pressure, and a second compressor stage for compressing, to a high pressure, the refrigerant of the principal mass flow that has been compressed to a medium pressure, and the auxiliary mass flow from the intermediate-pressure collector enters the second compressor stage of the refrigerant compressor unit for compressing to a high pressure, with the high pressure being higher than the medium pressure, and the medium pressure being higher than the low pressure;

wherein a drive chamber of the refrigerant compressor unit, from which the compressor stages are driven, is held at medium pressure, wherein the drive chamber of the refrigerant compressor unit receives the cylinder drives and borders on the cylinder units; and further comprising at least one inlet chamber supplying medium pressure to at least one cylinder unit for the second compressor stage, the at least one cylinder unit for the second compressor stage positioned radially between the at least one inlet chamber and the drive chamber.

2. The refrigeration system in accordance with claim 1, wherein, $CO_2$ is used as the refrigerant, and the low pressure lies at values in the range of 1 bar to 60 bar.

3. The refrigeration system in accordance with claim 1, wherein, $CO_2$ is used as the refrigerant, and the medium pressure lies in the range of 20 bar to 120 bar.

4. The refrigeration system in accordance with claim 1, wherein, $CO_2$ is used as the refrigerant, and the high pressure lies at values in the range of 50 bar to 160 bar.

5. The refrigeration system in accordance with claim 1, wherein the drive chamber is connected to a motor chamber of the refrigerant compressor unit via a connecting channel.

6. The refrigeration system in accordance with claim 1, wherein a high-pressure connection of the refrigerant compressor unit is arranged on a cylinder head of the second compressor stage.

7. The refrigeration system in accordance with claim 1, wherein a low-pressure connection of the refrigerant compressor unit is arranged on a cylinder head of the first compressor stage.

8. The refrigeration system in accordance with claim 1, wherein a medium-pressure outlet of the refrigerant compressor unit is arranged on a cylinder head of the first compressor stage.

9. The refrigeration system in accordance with claim 1, wherein a medium-pressure inlet of the refrigerant compressor unit is arranged in a portion of a motor housing.

10. The refrigeration system of claim 1, wherein the refrigerant circuit is integrated into a transport refrigeration system.

11. The refrigeration system of claim 1, wherein $CO_2$ is used as the refrigerant.

12. The refrigeration system in accordance with claim 1, wherein the first compressor stage of the refrigerant compressor unit is connected to a medium-pressure-side heat exchanger, which cools the principal mass flow that has been compressed to a medium pressure before said principal mass flow enters the second compressor stage.

13. The refrigeration system in accordance with claim 12, wherein the medium-pressure-side heat exchanger is an external heat exchanger arranged outside the refrigerant compressor unit.

14. The refrigeration system in accordance with claim 1, further comprising an electric drive motor, wherein the principal mass flow compressed to a medium pressure enters a motor chamber of the refrigerant compressor unit for cooling of the electric drive motor after the cooling by a medium-pressure-side heat exchanger and prior to entry into the second compressor stage.

15. The refrigeration system in accordance with claim 14, wherein the principal mass flow compressed to medium pressure and cooled in the medium-pressure-side heat exchanger enters the second compressor stage after having passed through the motor chamber.

16. The refrigeration system in accordance with claim 1, wherein the expansion member expands the total mass flow to an intermediate pressure.

17. The refrigeration system in accordance with claim 16, wherein the intermediate pressure is higher than the medium pressure, and in that the auxiliary mass flow is expanded to the medium pressure by an auxiliary mass flow expansion member and enters the second compressor stage at the medium pressure.

18. The refrigeration system in accordance with claim 16, wherein the intermediate pressure corresponds substantially to the medium pressure.

19. The refrigeration system in accordance with claim 1, wherein a housing of the refrigerant compressor unit is formed from aluminum.

20. The refrigeration system in accordance with claim 19, wherein the housing of the refrigerant compressor unit comprises a housing case and bearing covers arranged on respective different sides of the housing case, the housing case and the bearing covers all being formed with aluminum.

21. The refrigeration system in accordance with claim 19, wherein the housing comprises cylinder heads which are formed with aluminum.

22. The refrigeration system in accordance with claim 1, wherein a refrigerant compressor of the refrigerant compressor unit is formed as a reciprocating compressor.

23. The refrigeration system in accordance with claim 22, wherein the at least one cylinder unit of the second compressor stage is arranged at an angular spacing relative to the at least one cylinder unit of the first compressor stage, based on a central axis of a drive shaft of the cylinder units.

24. The refrigeration system in accordance with claim 22, wherein all cylinder units of the compressor stages are arranged in a row.

25. The refrigeration system in accordance with claim 22, wherein at least one of the cylinder units forms the first compressor stage and at least one of the cylinder units forms the second compressor stage.

26. The refrigeration system in accordance with claim 25, wherein at least two cylinder units form the first compressor stage.

27. The refrigeration system in accordance with claim 1, wherein the refrigerant compressor unit comprises a refrigerant compressor and an electric drive motor.

28. The refrigeration system in accordance with claim 27, wherein the refrigerant compressor unit is provided by a semi-hermetic compressor, wherein both the electric drive motor and the refrigerant compressor unit are arranged in an overall housing of said semi-hermetic compressor.

29. The refrigeration system in accordance with claim 27, wherein the auxiliary mass flow, prior to entering the second compressor stage, is supplied to a motor chamber of the refrigerant compressor unit in order to cool the electric drive motor.

30. The refrigeration system in accordance with claim 29, wherein the auxiliary mass flow enters the second compressor stage after cooling of the electric drive motor in the motor chamber.

31. A refrigerant compressor unit, comprising:

a refrigerant compressor;

an electric drive motor;

wherein the refrigerant compressor has (a) a first compressor stage for compressing, to a medium pressure, a refrigerant supplied at low pressure, and (b) a second compressor stage for compressing, to a high pressure, the refrigerant, that has been compressed to a medium pressure, with the high pressure being higher than the medium pressure, and the medium pressure being higher than the low pressure, the refrigerant compressor comprising a plurality of cylinder units and a plurality of cylinder drives;

wherein the refrigerant compressor unit comprises a medium-pressure outlet connected to the first compressor stage and a medium-pressure inlet connected to the second compressor stage;

wherein a drive chamber of the refrigerant compressor, from which the compressor stages are driven, is held at medium pressure, wherein the drive chamber of the refrigerant compressor receives the cylinder drives and borders on the cylinder units; and further comprising at least one inlet chamber supplying medium pressure to at least one cylinder unit for the second compressor stage, the at least one cylinder unit for the second compressor stage positioned radially between the at least one inlet chamber and the drive chamber.

32. The refrigerant compressor unit in accordance with claim 31, wherein the medium-pressure inlet opens out into a motor chamber of the electric drive motor for cooling the electric drive motor, and compressed refrigerant enters the second compressor stage after having passed through the motor chamber.

33. The refrigerant compressor unit in accordance with claim 31, wherein the drive chamber is connected to a motor chamber via a connecting channel.

34. The refrigerant compressor unit in accordance with claim 31, wherein the refrigerant compressor unit is formed as a semi-hermetic compressor, wherein both the electric drive motor and the refrigerant compressor are arranged in an overall housing of the semi-hermetic compressor.

35. The refrigerant compressor unit in accordance with claim 31, wherein the housing comprises cylinder heads which are formed with aluminum.

36. The refrigerant compressor unit in accordance with claim 31, wherein a high-pressure connection of the refrigerant compressor unit is arranged on a cylinder head of the second compressor stage.

37. The refrigerant compressor unit in accordance with claim 31, wherein a low-pressure connection of the refrigerant compressor unit is arranged on a cylinder head of the first compressor stage.

38. The refrigerant compressor unit in accordance with claim 31, wherein the medium-pressure outlet of the refrigerant compressor unit is arranged on a cylinder head of the first compressor stage.

39. The refrigerant compressor unit in accordance with claim 31, wherein the medium-pressure inlet of the refrigerant compressor unit is arranged in the region of a motor housing.

40. The refrigerant compressor unit in accordance with claim 31, wherein, $CO_2$ is used as the refrigerant, and the low pressure lies at values in the range of 1 bar to 60 bar.

41. The refrigerant compressor unit in accordance with claim 31, wherein, $CO_2$ is used as the refrigerant, and the medium pressure lies in the range of 20 bar to 120 bar.

42. The refrigerant compressor unit in accordance with claim 31, wherein, $CO_2$ is used as the refrigerant, and the high pressure lies at values in the range of 50 bar to 160 bar.

43. The refrigerant compressor unit of claim 31, wherein $CO_2$ is used as the refrigerant.

44. The refrigerant compressor unit in accordance with claim 31, further comprising a housing of the refrigerant compressor, the housing being formed from aluminum.

45. The refrigerant compressor unit in accordance with claim 44, wherein the housing comprises a housing case and, arranged on respective different sides of the housing case, bearing covers, wherein the housing case and the bearing covers are all formed with aluminum.

46. The refrigerant compressor unit in accordance with claim 31, wherein the refrigerant compressor is formed as a reciprocating compressor.

47. The refrigerant compressor unit in accordance with claim 46, at least one of the cylinder units forms the first compressor stage and at least one of the cylinder units forms the second compressor stage.

48. The refrigerant compressor unit in accordance with claim 47, wherein at least two cylinder units form the first compressor stage.

49. The refrigerant compressor unit in accordance with claim 47, wherein the at least one cylinder unit of the second compressor stage is arranged at an angular spacing relative to the at least one cylinder unit of the first compressor stage, based on a central axis of a drive shaft of the cylinder units.

50. The refrigerant compressor unit in accordance with claim 47, wherein all cylinder units of the compressor stages are arranged in a row.

* * * * *